United States Patent [19]

Shearer

[11] Patent Number: 4,944,515

[45] Date of Patent: Jul. 31, 1990

[54] HOLLOW GOLF CLUB HEAD WITH INTERNAL SUPPORT

[76] Inventor: William B. Shearer, 2905 W. Main St., Muncie, Ind. 47305

[21] Appl. No.: 293,451

[22] Filed: Jan. 4, 1989

[51] Int. Cl.[5] ..... A63B 53/04

[52] U.S. Cl. ..... 273/167 H; 273/171; 273/173

[58] Field of Search ..... 273/167–175

[56] References Cited

U.S. PATENT DOCUMENTS

| | | | |
|---|---|---|---|
| 690,940 | 1/1902 | Febiger | 273/170 |
| 1,673,973 | 6/1928 | Drevitson | 273/167 F |
| 4,535,990 | 8/1985 | Yamada | 273/167 H |
| 4,681,321 | 7/1987 | Chen et al. | 273/169 |
| 4,730,830 | 3/1988 | Tilley | 273/173 |

FOREIGN PATENT DOCUMENTS

| | | | |
|---|---|---|---|
| 2337985 | 2/1975 | Fed. Rep. of Germany | 273/170 |
| 398643 | 9/1933 | United Kingdom | 273/167 H |
| 2183491 | 6/1987 | United Kingdom | 273/167 J |

*Primary Examiner*—Edward M. Coven
*Assistant Examiner*—Sebastiano Passaniti
*Attorney, Agent, or Firm*—J. David Haynes

[57] ABSTRACT

A cast metal hollow headed golf club head having therewithin at least one internal structural support member disposed between the rear of the club head and the face of the club head, a first end of the internal structural support member being positioned at the geometric center of the face of the club head and a second end of the structural support member opening through the rear surface of the hollow headed golf club and having an open bottom thereto which a botton plate is permanently secured after the internal cavity of the hollow headed golf club is filled with a sound-proofing material, the internal structural member adapted to house additional metal or similar material to predetermine the resulting weight of the golf club head.

6 Claims, 3 Drawing Sheets

HOLLOW GOLF CLUB HEAD WITH INTERNAL SUPPORT

Background of the Invention

1. Field of the Invention.

This invention relates to an improvement in hollow headed golf clubs.

2. Background Information.

The ancient game of golf is securely embedded in American culture. Ardent participants agressively address the ellusive golf ball to cause it to be propelled a desired distance along a predetermined path.

Throughout the evolution of the game, the design and construction of golf clubs has constantly undergone change. Traditionally the modern-day collection of clubs encompasses so-called irons, woods, pitching wedges and putters. Their design and construction varies to appeal to the golfer's expectation that it is the club which improves the possibility of winning.

Modern day club collections generally include clubs referred to as "woods." Made of hard wood, often laminated, these clubs vary in weight and face pitch to predict a desired pitch and loft for a desired but seldom-achieved perfect swing.

Should the surface of the wood strike the ball incorrectly, damage may result to the club. The laborous and exacting skill of fashioning a wooden golf club head known as a "wood" is demanding. The cost is dependent upon the preciseness with which the head is fashioned, material, weighting, and embellishment.

A known alternative to manufacturing a "wood" from wood is to cast the wood form of metal and to leave the interior of the club hollow. The thickness of metal, the size of the club and the weight of the bottom plate attached to the casting determine its weight, the amount of which desirably varies from big to small golfers of various strengths. The body of the club head is cast without a bottom plate which plate is secured to the club head after the casting procedure.

The hollow head wood made from metal has received reasonable acceptance in the golfing sport, even though an overpowering stroke may cause deformation of the face of the club head. Even though the hollow headed clubs may look and feel the same as the real wooden clubs, the sound caused when the club head strikes the ball is noticeably different from the sound caused when a wooden club head strikes a ball. Often, an over-zealous golfer may dent the face of the club by performing a too-powerful drive or my improperly engaging the golf ball; the face of the club head may be deformed.

The hollow headed clubs are usually filled with foam to attempt to muffle the hollow sound. Nevertheless, there is a need for innovation in this developing art to enhance the sound and the durability of the clubs.

SUMMARY OF THE INVENTION

One or plural linear structural support members are placed between the face of a hollow golf club head and the rear thereof to improve the resilience and strength of the face of the club. The support member(s) are parallel to the bottom of the club and are aligned with the horizontal center line of the face of the club. The structural support members may also slope from the front to the back of the club head. If a single support member is used, it is aligned with the geometric center of the face of the club. The structural member is tubular with an open end thereof extending through the rear of the club head to form a circular or hexagonial or other configured cavity open at the rear of the club and closed at its other end by the inside surface of the face of the club. Mass may be inserted into the cavity to regulate the weight of the club head.

The structural member(s) support the face of the club during impact to increase the accuracy and distance achieved, to enhance the sound to resemble that of a real wooden club, and to retard deformation of the club head.

The club head is cast as an unitary structure with the structural support member(s) being integral thereto. The casting may then be weighted and filled before the bottom plate of the club head is permanently affixed thereto.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
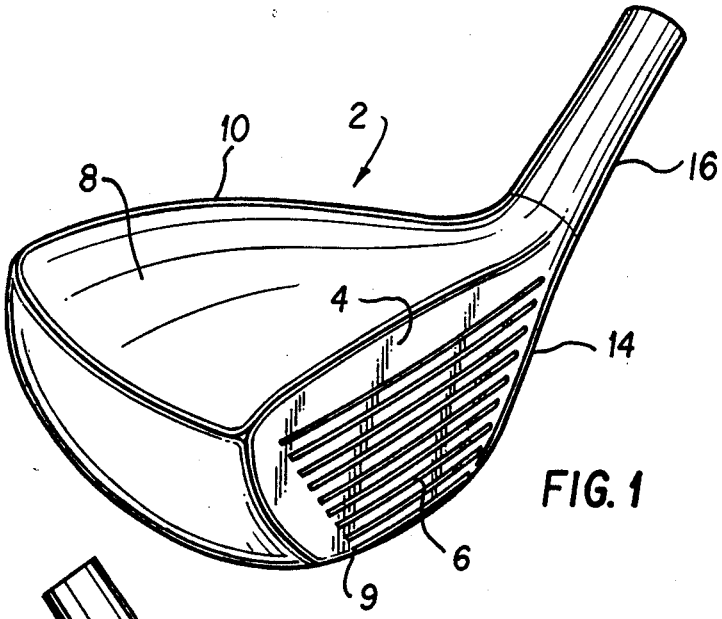
FIG. 1 is a perspective view of a preferred embodiment of the invention.

While this invention is susceptible of embodiment in many different forms, there are shown in the drawings and will here be described in detail preferred embodiments of the invention. It should be understood, however, that the present disclosure is to be considered as an exemplification of the principles of the invention and is not intended to limit the invention to the embodiments illustrated. The precise shape or size of the golf club head is not essential to the invention unless otherwise indicated, since the invention is described with only reference to embodiments which are single and straight forward.

Referring now to FIG. 1, there is shown a hollow golf club head 2 in the shape of what is generally referred to in the art as a "wood". Woods vary in size and pitch of the face. Face 4 generally has a plurality of grooves 6 across its surface which engage the golf ball to impart rotation to the ball and to engage the ball to aid in propelling the ball in a forward direction.

The pitch of face 4 varies with the club design to determine the pitch and loft of a golf ball struck with the club. Traditionally, woods are given numbers such as "1" or "driver" and 2, 3, 4, et cetera. The present invention has equal application to all hollow headed woods regardless of number and size.

The club head comprises a face 4, a rear 10, a top 8, a bottom 9, a toe 12, a heel 14 and an hossel 16. The club head also comprises a base plate 18 as shown in FIG. 2.

Figure 2:
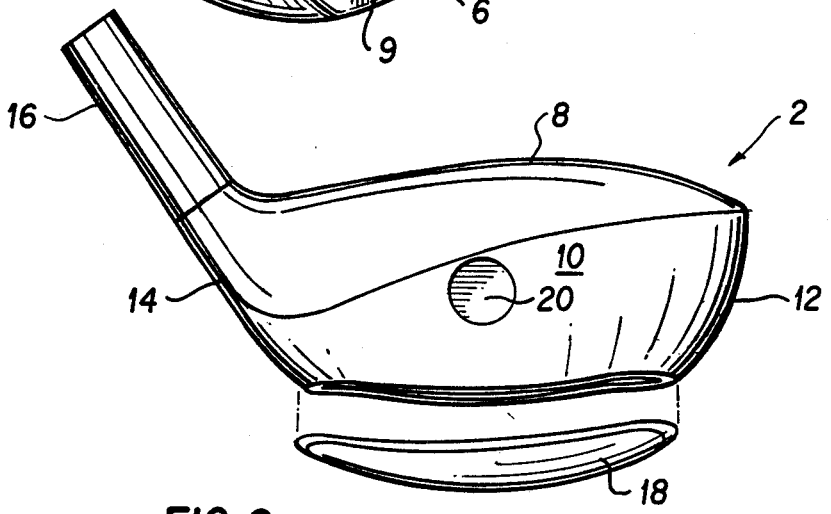
FIG. 2 is a rear perspective view of a golf club head showing the bottom plate removed and disclosing a single circular support member extending from the face to the back of the club head.

Referring now to FIG. 2, a single circular support member 20 is disposed in the rear 10 of golf club 2. Support member 2 may take the form of a circular cross-section as shown in FIG. 2 or it may have other geometric forms, a particular alternative being disclosed in FIG. 6 to be hexagonial.

Structural support member 20 (FIG. 2) extends from back 10 of club head 2 to face 4 of the club head 2. The structural support member 20 is hollow, its interior communicating with the atmosphere outside the hollow golf club head 2. If one were to look into the open end of structural support member 20, one would, at the other end thereof, see the inside surface of the face of the hollow golf club head. Alternatively, support member 20 may be completely enclosed within the club head.

The preferred manufacturing process for the hollow headed golf club requires that the club head be cast of metal, plastic or similar material with the structural member and the remaining structure of the hollow golf club head, bottom plate 18 excepted, being formed in a single casting procedure. Alternatively, the golf club head could be cast and then the circular support member affixed thereinto. Nevertheless, the desirable and most expedient method of manufacture would be to cause the structure, excepting the bottom plate 18 to be formed in a single casting procedure.

Figure 4:
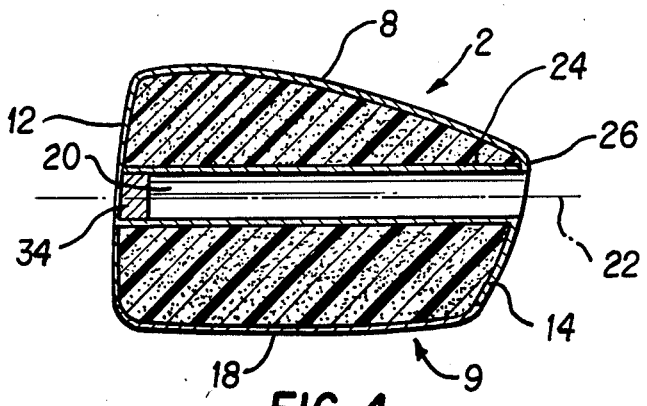
FIG. 4 is a cross-sectional view of a golf club head along the center line of a structural support member taken along line 4—4 of FIG. 3.

Referring now to FIG. 4, golf club head 2, according to the preferred embodiment, is shown in cross-section. It can be seen that the interior of the golf club head is hollow and has internal surfaces that generally conform to the external configuration of the club head. Structural support member 20 extends from the internal surface of face 12 to the internal surface of back or rear 14 of the club head. Structural member 20 opens through the rear of the club head although in alternate embodiments, the rear surface of the club could be closed.

Ideally, the upper-most surface 24 of the internal structural support member 20 adjoins rear 14 of the golf club head at apex 26 where top 8 of the club head joins rear 14. The hollow interior of the club head is filled with material such as foam for purposes of weighting the club head and for insulating the sound generated by striking a golf ball.

Figure 5:
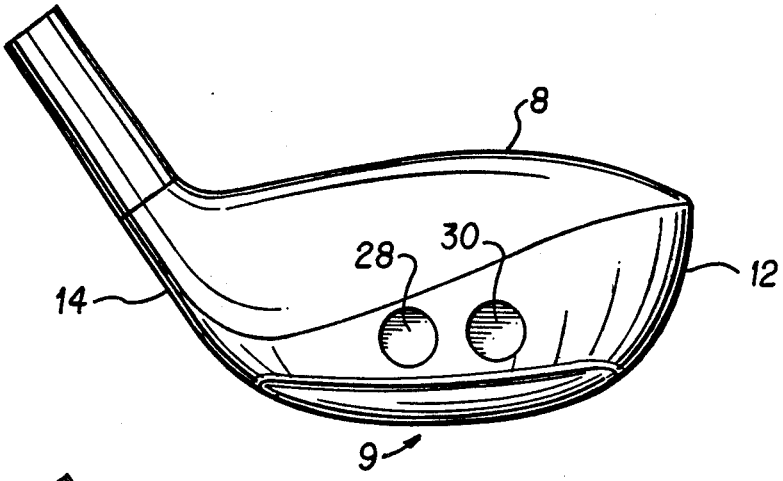
FIG. 5 is a rear view of an alternative embodiment of a club head showing two circular support members.

While the present invention has been first described with reference to a preferred embodiment, other embodiments are also envisioned utilizing internal structural support members. FIG. 5 discloses such an alternative embodiment where two structural members 28 and 30 are positioned between the front surface 12 and the rear surface 14 of the hollow club head. While these two structural support members 28 and 30 be positioned as structural member 20 is disclosed in FIG. 4 relative to the top 8 and the bottom 18 of the club head, their longitudinal axes would be positioned respectively on either side of the so-called "sweet spot" such that the point of impact between the club face 12 and the golf ball would be centered between the two structural support members.

Figure 6:
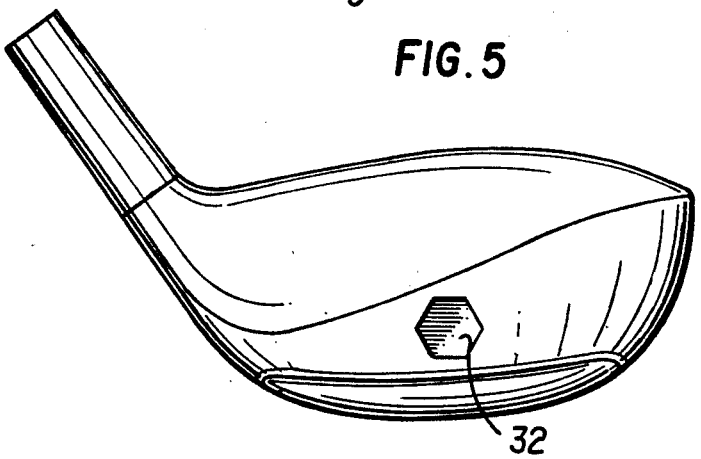
FIG. 6 is a rear view of an alternative embodiment of a golf club head showing a hexagonial structural support member.
Figure 7:
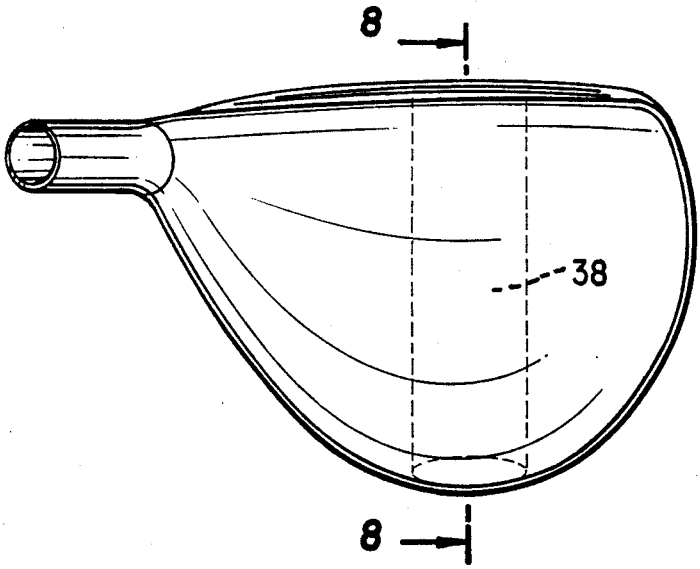
FIG. 7 is a top view of a golf club head disclosing an alternative embodiment of the present invention.

Yet another embodiment of the present invention is disclosed in FIG. 6. While the geometric shape of the structural support members 20, 28 and 30 have been disclosed as circular, the shape may also be hexagonial as disclosed by structural support member 32 or be square or comprise other configurations.

Figure 8:
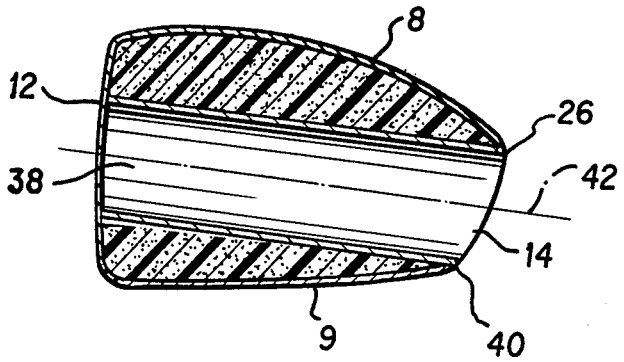
FIG. 8 is a cross-sectional view taken along line 8—8 of FIG. 7 disclosing a internal support member having a diameter as wide as the height of the rear of the club and disposed at an angle other than 90 degrees to the face of the club head.

The diameter of the internal structural support member may be of varying dimensions. FIG. 8 discloses a top view of a hollow headed golf club which has an internal support member 38 having a diameter greater than the diameter of internal support member 20 disclosed in FIG. 3. The diameter may be as great as the length of the rear of the club between the apex 26 and the apex 40 (FIG. 8).

It should be noted that the base plate 18 has been disclosed as substantially planar. Actually, the base plate, although substantially planar, actually is slightly oval at its outer surface. The casual observer sees the base plate as flat while it is slightly curved as it approaches the face and the rear of the club head. This structure is standard in the art.

As the "number" of the wood increases from one or driver to 2 to 3 and so on, the size of the club head becomes increasingly smaller. Actually one may have a complete set of golf clubs comprising only woods and perhaps a putter and a pitching iron. As the size of the club head decreases, the rear surface 14 becomes smaller from the top 8 to the bottom 9 of the club head. Therefore, in order for the centerline of the internal structural support member to abut the face 12 of the club at its geometric center or its sweet spot, the trajectory of the internal support member is other than substantially parallel with the base 9 of the club head as disclosed in FIG. 8. In this embodiment, the axis 47 of internal support member 38 would not be perpendicular to the golf ball at time of impact. Nevertheless, the internal structural support member provides the support and stability to the club head to retard deformation or damage to the club head during use.

Figure 3:
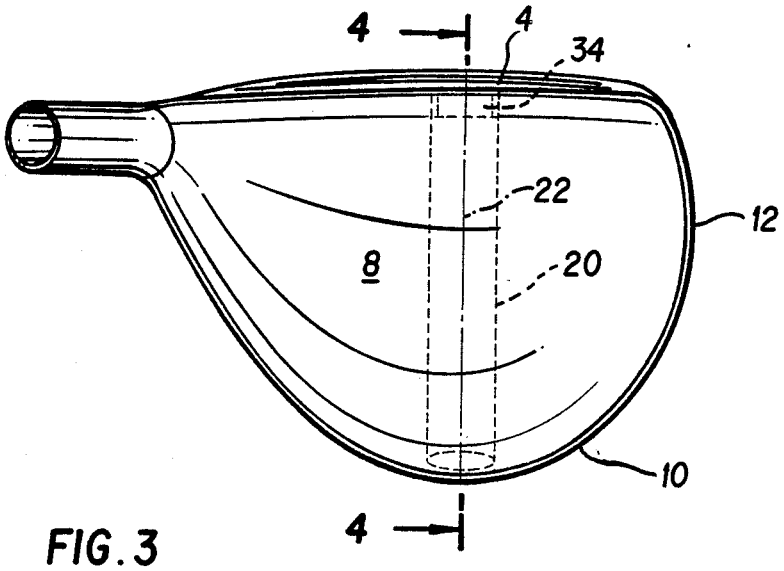
FIG. 3 is a top view of golf club head showing a singular support member therethrough.

The weight of the golf club head may be varied to predetermined weights through the use of weights positioned within the structural support members. As shown in FIGS. 3 and 4, weight 34 may be secured internal to structural support member 20 by conventional means or may be cast thereinto during the formation process of the hollow headed club.

Many other modifications within the scope and spirit of this invention will be readily apparent to those skilled in the art.

I claim:

1. A hollow golf club head having a face, a back, a toe, a heel, a top and a bottom which comprise the exterior surface of said club head wherein said club head has an interior comprising a cavity having a dimension conforming to the general exterior surface configuration of said club and a linear support member extending between an internal surface of the face of said club head and an internal surface 9 of the back of said club head and wherein the exterior surface of the bottom has a substantially planar surface and wherein said linear support member has a longitudinal axis which is substantially parallel to said planar surface wherein said face of said club head has a substantially planar surface having a geometric center and wherein said linear support member abuts said internal surface of said face at said geometric center, said linear support member having a first end and a second end and a cavity extending from the first end of said linear support member through the second end of said linear support member and wherein said cavity in said linear support member extends through the back exterior surface of said club whereby said cavity of said linear support member is visible from the exterior of said club head, whereby abutment of said linear support member against the internal surfaces of the face and back affords increased structural integrity to retard deformation of the club head during an impact.

2. A hollow golf club head as set forth in claim 1 wherein said linear support member is fixedly joined to the back of said club head and wherein said linear support member is tubular.

3. A hollow golf club head as set forth in claim 1 and further comprising a weight removably receivable into said linear support member whereby the weight of the golf club head may be selectively determined.

4. A hollow golf club head having a face, a back, a toe, a heel, a top and a bottom which comprise the exterior surface of sad club head wherein said club head has an interior comprising a cavity having a dimension conforming to the general exterior surface configuration of said club and a linear support member extending between an internal surface of the face of said club head and an internal surface the back of said club head and wherein the exterior surface of the bottom has a substantially planar surface and wherein said linear support member has a longitudinal axis which slopes downwardly from said face of said club head toward said bottom of said club head said face of said club head having a substantially planar surface having a geometric center and wherein said linear support member abuts said internal surface of said face at said geometric center, said linear support member having a first end and a second end and a cavity extending from the first end of said linear support member through the second end of said linear support member and wherein said cavity in said linear support member extends through the back exterior surface of said club whereby said cavity of said linear support member is visible from the exterior of said club head, whereby abutment of said linear support member against the internal surfaces of the face and back affords increased structural integrity to retard deformation of the club head during an impact.

5. A golf club head as set forth in claim 4 wherein said linear support member is fixedly joined to the back of said club head and wherein said linear support member is tubular and has an outside diameter equal to the vertical distance between said top and said bottom of said golf club head at said back thereof.

6. A hollow golf club head as set forth in claim 4 and further comply a weight removably receivable into said linear support member whereby the weight of the golf club head may be selectively determined.

* * * * *